US009038246B2

(12) United States Patent
Liang

(10) Patent No.: US 9,038,246 B2
(45) Date of Patent: May 26, 2015

(54) CABLE TIE

(75) Inventor: Davey Z. Liang, Rancho Santa Fe, CA (US)

(73) Assignee: Shining Golden Yida Welding & Cutting Machinery Manufacture Ltd., Tsimshatsui, Kowloon (HK)

( * ) Notice: Subject to any disclaimer, the term of this patent is extended or adjusted under 35 U.S.C. 154(b) by 0 days.

(21) Appl. No.: 13/457,447

(22) Filed: Apr. 26, 2012

(65) Prior Publication Data

US 2012/0272485 A1 Nov. 1, 2012

Related U.S. Application Data

(60) Provisional application No. 61/479,148, filed on Apr. 26, 2011.

(51) Int. Cl.
*B65D 63/12* (2006.01)
*B65D 63/10* (2006.01)

(52) U.S. Cl.
CPC ..... *B65D 63/1072* (2013.01); *Y10T 24/1498* (2013.01)

(58) Field of Classification Search
CPC ..... B65D 63/1072; B65D 63/1081; B65D 2563/106; B65D 63/1063; B65D 2563/103; F16L 3/2334; F16L 3/2332; F16L 3/233; F16L 3/2336; B29L 2031/7276; B29C 45/0055; B29C 45/4407; B29C 55/00
USPC ..... 24/16 PB
See application file for complete search history.

(56) References Cited

U.S. PATENT DOCUMENTS

| | | | | |
|---|---|---|---|---|
| 3,102,311 | A | | 9/1963 | Martin et al. |
| 3,654,669 | A | * | 4/1972 | Fulton ..... 24/16 PB |
| 3,672,003 | A | | 6/1972 | Morgan |
| 3,717,906 | A | | 2/1973 | Wells |
| 3,761,999 | A | | 10/1973 | Morgan |
| 3,872,547 | A | | 3/1975 | Caveney et al. |
| 3,949,449 | A | | 4/1976 | Caveney et al. |
| 4,473,524 | A | | 9/1984 | Paradis |
| 4,532,679 | A | | 8/1985 | Scott |
| 4,580,319 | A | | 4/1986 | Paradis |
| 4,658,478 | A | | 4/1987 | Paradis |
| 4,688,302 | A | * | 8/1987 | Caveney et al. ..... 24/16 PB |
| 4,754,529 | A | | 7/1988 | Paradis |

(Continued)

OTHER PUBLICATIONS

"Product Catalog", *Gardner Bender; "Cable Ties" Product Catalog*; pp. 145-152; Unknown publication date but believed to be prior to filing of present application.

*Primary Examiner* — Robert J Sandy
*Assistant Examiner* — David Upchurch
(74) *Attorney, Agent, or Firm* — Philip H. Burrus, IV

(57) ABSTRACT

A cable tie has a flexible, elongated strap with a head and tail at opposite ends. The strap has two opposed sides, with teeth on both sides. The head includes an opening for receiving the strap, a movable pawl with teeth on one side of the opening and, on the opposite side of the opening, an abutment surface having an abutment tooth. The head may include a molding line adjoining the apex of the abutment tooth. The cable tie may be used to retain articles by looping the strap around the articles, and inserting the strap, tail first, into the opening, whereby the pawl teeth and abutment teeth may be brought into engagement with the teeth on the two opposed sides, respectively, at least when retraction force is applied to the strap, such as to lock the strap in the head, preventing retraction of the strap from the head.

19 Claims, 6 Drawing Sheets

(56) References Cited

U.S. PATENT DOCUMENTS

| | | | | | |
|---|---|---|---|---|---|
| 4,776,067 | A | | 10/1988 | Sorensen | |
| 5,146,654 | A | * | 9/1992 | Caveney et al. | 24/16 PB |
| 5,389,330 | A | | 2/1995 | Sorensen et al. | |
| 5,440,786 | A | * | 8/1995 | Sorensen et al. | 24/16 PB |
| 5,470,520 | A | * | 11/1995 | Sorensen et al. | 264/297.2 |
| 5,642,554 | A | * | 7/1997 | Sorensen et al. | 24/16 PB |
| 5,664,294 | A | * | 9/1997 | Sorensen et al. | 24/16 PB |
| 5,792,409 | A | * | 8/1998 | Sorensen et al. | 264/297.2 |
| 5,884,367 | A | * | 3/1999 | Teagno et al. | 24/16 PB |
| 5,911,368 | A | * | 6/1999 | Davignon | 24/16 PB |
| 5,924,171 | A | * | 7/1999 | Sorensen et al. | 24/16 PB |
| 6,185,792 | B1 | * | 2/2001 | Nelson et al. | 24/16 PB |
| 6,190,599 | B1 | * | 2/2001 | Sorensen et al. | 264/318 |
| 6,347,434 | B1 | * | 2/2002 | Newman | 24/16 PB |
| 6,658,703 | B1 | * | 12/2003 | Teagno et al. | 24/16 PB |
| 7,127,779 | B2 | * | 10/2006 | Hewes | 24/16 PB |
| 7,520,030 | B2 | | 4/2009 | Laporte | |
| 7,730,592 | B2 | | 6/2010 | Krisel | |
| 7,774,905 | B2 | | 8/2010 | Geiger | |
| 2006/0123603 | A1 | * | 6/2006 | Hewes | 24/16 PB |

* cited by examiner

CABLE TIE

CROSS-REFERENCE TO RELATED APPLICATIONS

This application claims the benefit of the filing date of U.S. provisional patent application No. 61/479,148, incorporated herein by reference, which was filed on Apr. 26, 2011, by the same inventor of this application.

TECHNICAL FIELD OF THE PRESENT DISCLOSURE

The present disclosure relates in general to fastening devices. More particularly, this disclosure pertains to a type of fastening device commonly known as a "cable tie" or "zip tie," and various designs, features, and aspects thereof.

BACKGROUND OF THE PRESENT DISCLOSURE

A cable tie may be used, for example, to retain a bundle of elongated cables, or other articles. To do so, the flexible cable tie is formed into a loop around the articles, and the strap is inserted through an opening in the head and appropriately tensioned. The cable tie may be designed to effectively lock the strap in the head (prevent retraction of the strap from the head) so as to secure the articles being retained. While cable ties have undergone a wide range of developments over the years, there remains room for improvement in the functionality thereof, for example, in rendering the retaining function more secure and reliable, and in rendering the use or installation of the cable tie, e.g., the insertion and locking of the strap in the head, easier and more convenient for users.

SUMMARY OF THE PREFERRED EMBODIMENTS

According to a first aspect of the invention, there is provided a fastening device, comprising a flexible, elongated strap having longitudinally opposed first and second end portions and a body portion therebetween, the body portion having opposed first and second broad sides and strap teeth on each of the first and second broad sides. A head is disposed at the first end portion, the head having (a) a perimeter wall surrounding an opening, and (b) a movable pawl extending from the perimeter wall into the opening, the movable pawl having at least one pawl tooth, the perimeter wall including an abutment portion opposite the movable pawl, and the abutment portion including an abutment tooth opposite the movable pawl. A tail is disposed at the second end portion. The opening is dimensioned to accommodate insertion, tail first, of the strap through the opening. The strap teeth on the first broad side and the at least one pawl tooth are respectively configured for engagement therebetween, upon the tail-first insertion of the strap through the opening, and the strap teeth on the second broad side and the abutment tooth are respectively configured for engagement therebetween, upon the tail-first insertion of the strap through the opening.

According to a second aspect of the invention, in the fastening device of the first aspect, the abutment tooth has an apex, and the head has a molding line adjoining the apex of the abutment tooth.

According to a third aspect of the invention, in the fastening device of the first aspect, the abutment tooth has a working surface inclined in a direction opposite a direction of insertion.

According to a fourth aspect of the invention, in the fastening device of the first aspect, at least one of the strap teeth on the second broad side has a working surface that, upon the tail-first insertion of the strap through the opening, is inclined in a direction of insertion.

According to other aspects of the invention, methods of manufacturing a fastening device and methods of using a fastening device are provided.

BRIEF DESCRIPTION OF THE DRAWINGS

The following figures form part of the present specification and are included to further demonstrate certain aspects of the present claimed subject matter, and should not be used to limit or define the present claimed subject matter. The present claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION OF ONE OR MORE EMBODIMENTS

Figure 1:
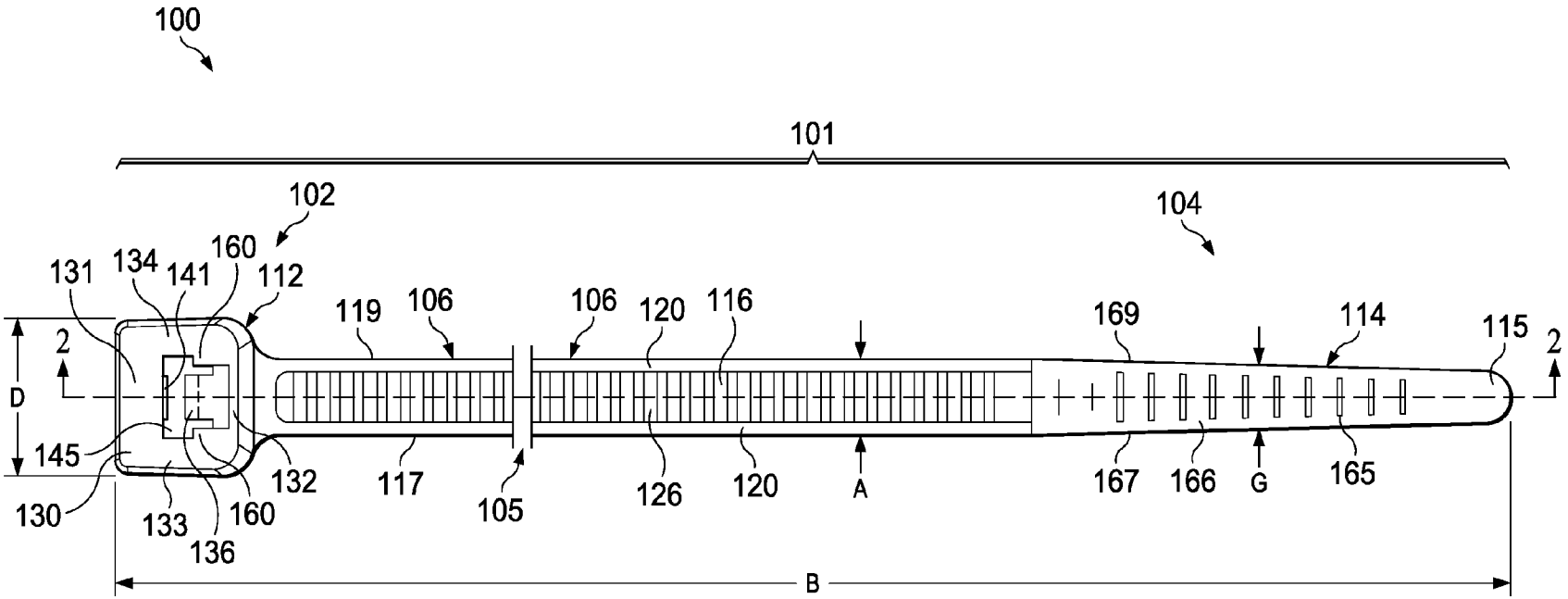
FIG. 1 is a schematic diagram showing a plan view of a cable tie as seen from the top, in accordance with some embodiments of the present disclosure.

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

While various embodiments are described herein, it should be appreciated that the present invention encompasses many inventive concepts that may be embodied in a wide variety of contexts. The following detailed description of exemplary embodiments, read in conjunction with the accompanying drawings, is merely illustrative and is not to be taken as limiting the scope of the invention, as it would be impossible or impractical to include all of the possible embodiments and contexts of the invention in this disclosure. Upon reading this disclosure, many alternative embodiments of the present invention will be apparent to persons of ordinary skill in the art. The scope of the invention is defined by the appended claims and equivalents thereof.

Illustrative embodiments of the invention are described below. In the interest of clarity, not all features of an actual implementation are described in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

With regard to terminology, the use of the term "preferable" or "preferably" is to be understood as indicating, inter alia, that the stated matter need not be as stated and that alternatives and contraries to the stated matter may obtain, unless indicated otherwise. For example, if it were stated that a widget preferably has a certain characteristic (e.g., a component is preferably inclined at a certain angle, or two components preferably correspond in a certain manner, etc), it is thereby indicated that the widget may also not have the certain characteristic, may have a different or contrary characteristic, etc., unless indicated otherwise. In this regard, it could be the case that, within a given embodiment, an element may not be able to have a contrary characteristic, but that in a different embodiment, the element can have the contrary characteristic. Nonetheless, unless indicated otherwise, different embodiments are combinable with one another (combinations of more than two embodiments being possible), and any number of features of different embodiments are combinable with one another.

The structure, manufacture and operation of cable ties according to preferred embodiments will be described with reference to the figures.

With initial reference to FIGS. 1-3 and 5, a cable tie 100 in accordance with some embodiments includes a flexible, elongated strap 101. Strap 101 has longitudinally opposed first and second end portions 102 and 104, respectively, and elongated body portion 106 between end portions 102 and 104. As denoted by reference numeral 105 (FIGS. 1 and 2), the blank space bounded by two parallel lines that cut through body portion 106 indicates that a portion of body portion 106 may be omitted from the figures. The length of strap 101 is indicated by B in FIG. 1. Head 112 is formed at end portion 102, and tail 114 is formed at end portion 104.

Body portion 106 has two opposite wide or broad sides, which may also be referred to as top and bottom, 116 and 118, respectively, which extend the length of body portion 106, from head 112 to tail 114. As will be explained below, bottom 118 will contact the articles to be tied together by cable tie 100 when cable tie 100 is formed into a loop to encircle the articles and tie them together. As shown in FIG. 1, each of top 116 and bottom 118 has a width A. Body portion also has two opposite short sides, 117 and 119, respectively, each extending between top 116 and bottom 118, such as to provide body portion 106 with an at least substantially rectangular cross section (not shown). The width of each short side 117, 119, in other words, the distance from top 116 to bottom 118, is denoted C in FIG. 2. C may also be described as the thickness of body portion 106.

Figure 2:
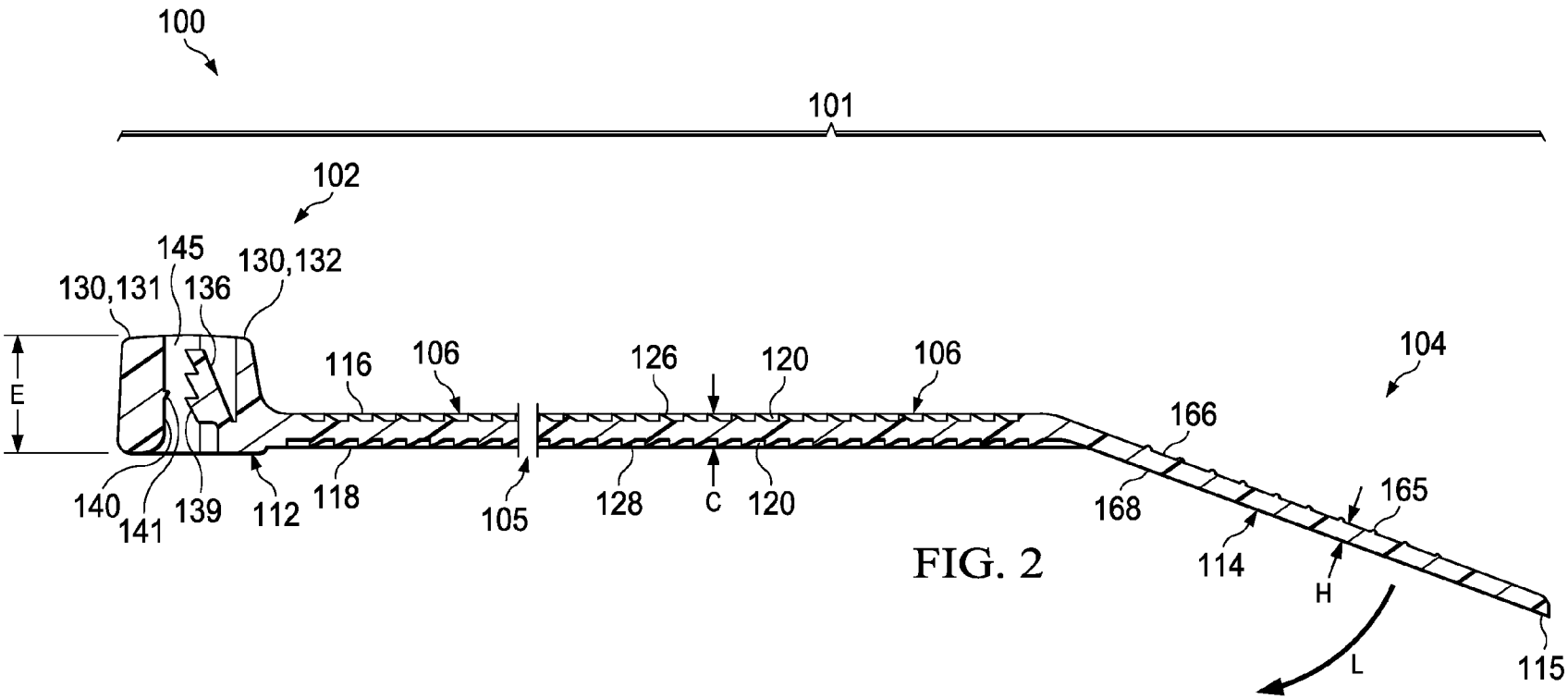
FIG. 2 is a schematic diagram showing a side elevational, or cross-sectional, view of the cable tie shown in FIG. 1, taken along the line 2-2 in FIG. 1, in accordance with some embodiments of the present disclosure.

Top 116 has strap teeth 126 and bottom 118 has strap teeth 128. The strap teeth 126, 128 extend transversely to top 116 or bottom 118, respectively, (i.e., perpendicular to the longitudinal direction of top 116 or bottom 118, respectively), and are spaced apart from one another with a spacing that may be uniform for all the pairs of adjacent teeth. Each set of strap teeth 126, 128 extends along a portion of top 116 or bottom 118, respectively, e.g., most of, or at least substantially the entirety of, top 116 or bottom 118, respectively, as seen in FIGS. 1 and 2. As explained below, teeth 126, 128 may be deemed ratchet teeth. The space between any two adjacent strap teeth 126, or between any adjacent two strap teeth 128, may be deemed a recess.

Body portion 106 may also have edge rails 120, one edge rail 120 extending along each edge of top 116 (shown in FIG. 1) and bottom 118 (not shown), for at least substantially the length of body portion 106. (Edge rails 120 in bottom 118 may have the same construction as edge rails 120 in top 116.) As seen in FIG. 1, edge rails 120 thus extend in a direction perpendicular to strap teeth 126, and edge rails 120 bound strap teeth 126 at the longitudinal ends thereof. Thus, the length of each strap tooth 126 is less than the width A of body portion 106, by an amount equal to twice the width of an edge rail 120. Edge rails 120 may be formed so as to be raised (on the surface of top 116) above the tops of strap teeth 126 (that is, edge rails on top 116 would extend outward of the plane of the paper in FIG. 1 to a greater extent than strap teeth 126 would). Alternatively, as seen in FIG. 2, edge rails 120 may extend (in the vertical direction in the figure) just up to tops of strap teeth 126. In FIG. 2, partial outlines of edge rails 120 are generally indicated by the two horizontal parallel lines bounding strap teeth 126 and 128, respectively. Particularly when raised above the surface of the broad sides 116, 118, edge rails 120 may assist in guiding strap 101 through head 112 so as to be appropriately located with respect to the sides of the head, the pawl, and/or the abutment tooth, as will be understood from the discussion hereinbelow. Nonetheless, cable tie 100 may be formed without edge rails 120, or with edge rails 120 only on top 116 or only on bottom 118.

Head 112 has a perimeter wall 130, which may be understood to be formed of front wall 131, rear wall 132, and side walls 133, 134. Perimeter wall 130 surrounds opening 145, which extends from the bottom of head 112 to the top of head 112 as shown in FIG. 2, and through which strap 101 may be inserted, as discussed hereinbelow. At the bottom of head 112, opening 145 may be deemed to have an entry 144, while at the top of head 112, opening 145 may be deemed to have an exit 146, the labels "entry" and "exit" being applied with reference to the insertion of strap 101 through opening 145 in the use of cable tie 100 to retain articles, as discussed hereinbelow. With reference to the directions as illustrated in FIG. 2, the bottom of perimeter wall 130, or of walls 131-135, may be referred to as an entry surface thereof, while the top of perimeter wall 130, or of walls 131-135, may be referred to as an exit surface thereof. In accordance with some embodiments, perimeter wall 130 extends completely around head 112 at a uniform height or vertical extent (vertical direction in FIG. 2); there is no gap or break in perimeter wall 130. According to other embodiments, perimeter wall 130 may have a gap, e.g., in rear wall 132, behind the pawl (discussed below), i.e., between the pawl and body portion 106. According to some embodiments, perimeter wall 130 need not have a uniform height or vertical extent. In FIG. 1, D indicates the length of front wall 131, while in FIG. 2, E indicates the height of front wall 131.

Head 112 further includes a movable pawl 136. Movable pawl 136 is hinged via hinge 137 to hinged extension portion, or projection, 138, which projects from rear wall 132 into opening 145 toward front wall 131, at the foot or bottom of rear wall 132. (See, e.g., FIG. 3.) Pawl 136 is movable in to and fro, or forward and rearward, directions, toward and away from front wall 131 or, equivalently, away from and toward rear wall 132, as indicated by the arrows F (forward; toward front wall 131) and R (rearward; away from front wall 131) in, e.g., FIG. 3. The design, e.g., shape, configuration, etc., of hinge 137 and/or projection 138 may be varied from the illustrated design, as will be understood by one of ordinary skill in the art.

Figure 3:
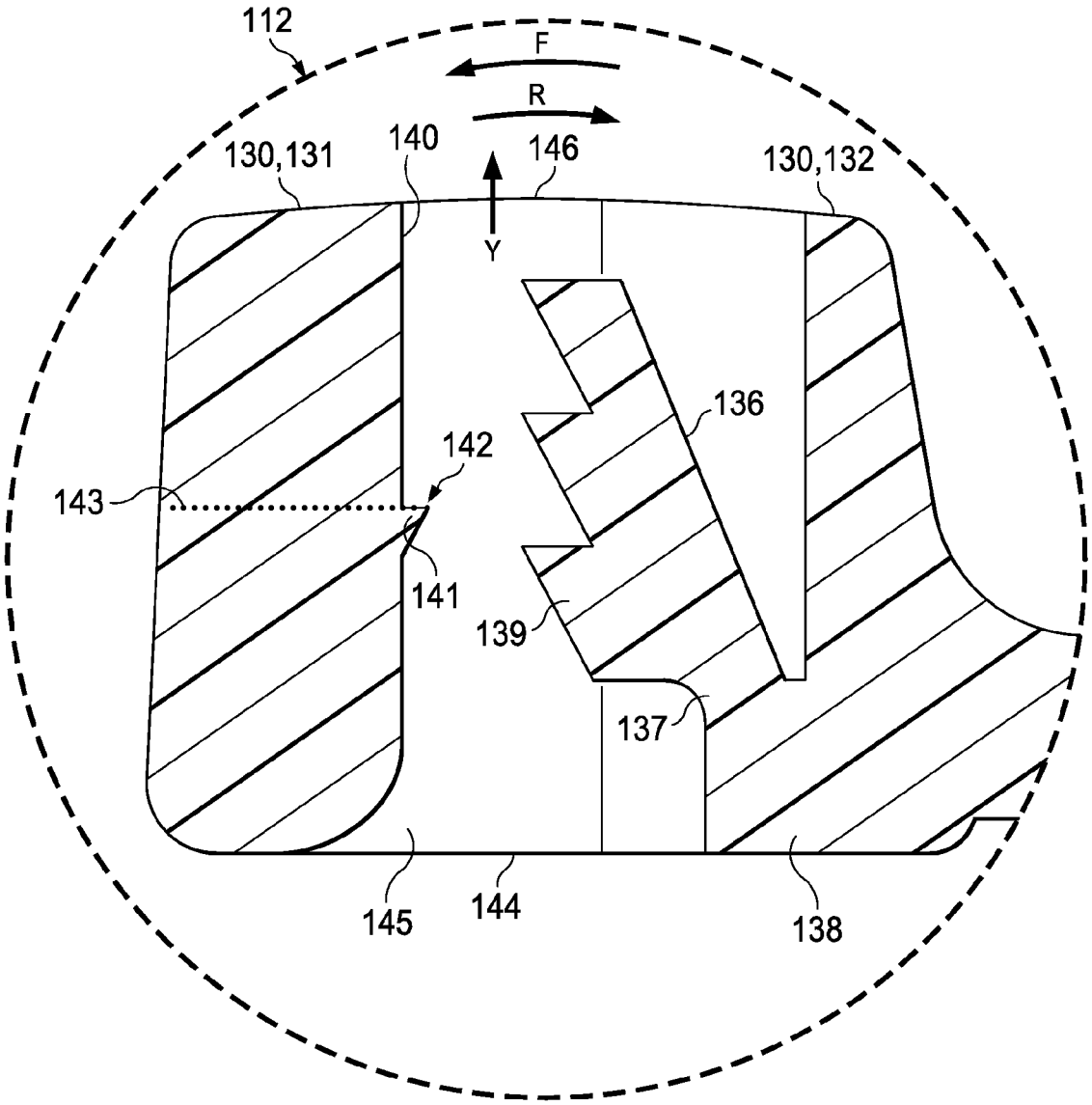
FIG. 3 is a close-up view of the head of the cable tie shown in FIG. 2, in accordance with some embodiments of the present disclosure.

As shown, e.g., in FIG. 3, pawl 136 has one or more pawl teeth 139, which may be described as being arranged transversely with respect to pawl 136. In accordance with some embodiments, pawl 136 has three pawl teeth 139, as shown in the figures; but according to other embodiments, pawl may have a smaller or larger number of pawl teeth 139. As discussed below, pawl tooth or teeth 139 are configured for engaging bottom strap teeth 128 when strap 101 has been inserted into opening 145, tail 114 first, with bottom strap teeth 128 facing pawl 136.

Figure 4:
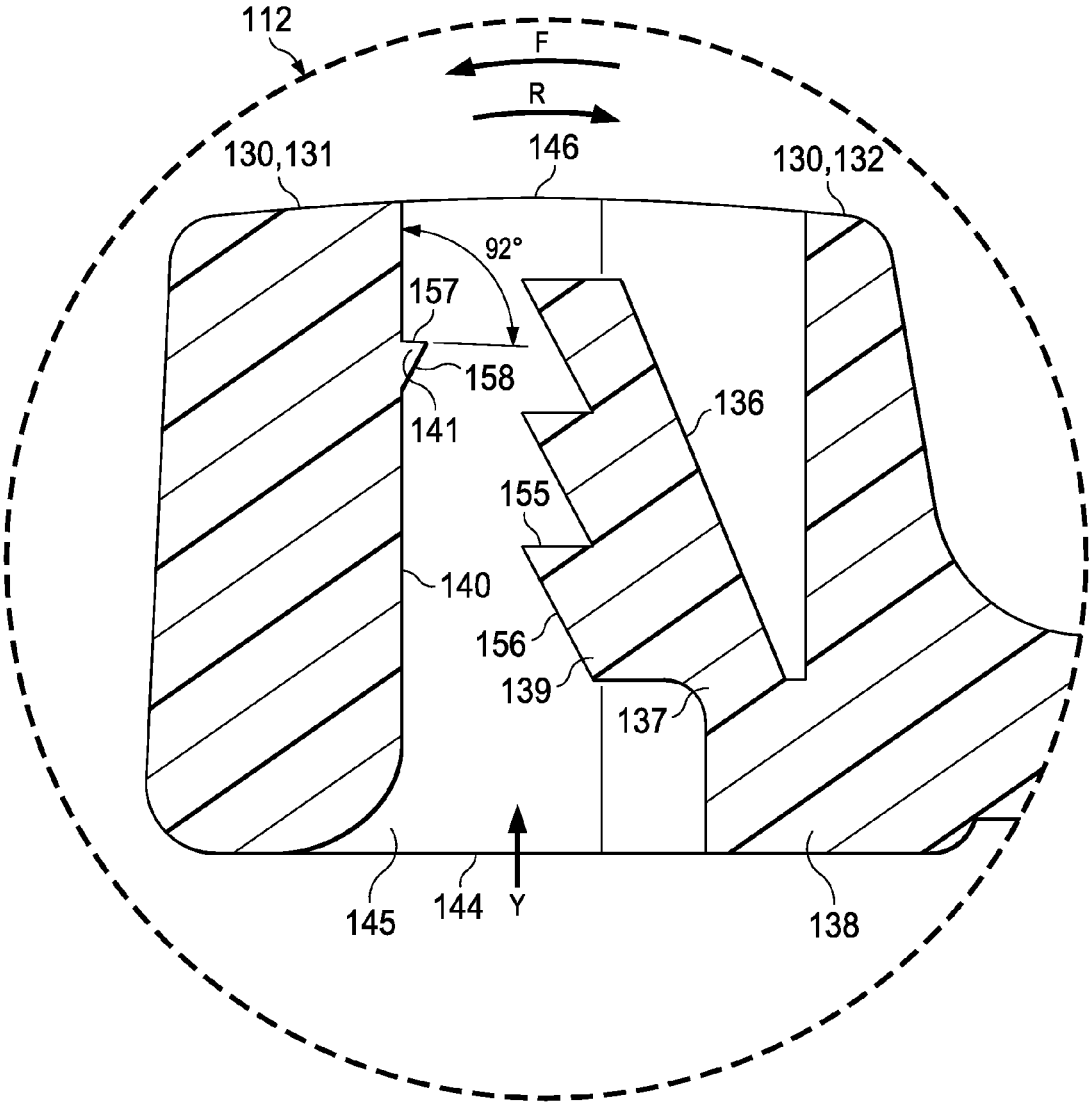
FIG. 4 is a schematic diagram showing a side elevational, or cross-sectional, close-up view, similar to that of FIG. 3, of a head of a cable tie, in accordance with some alternative embodiments of the present disclosure.
Figure 5:
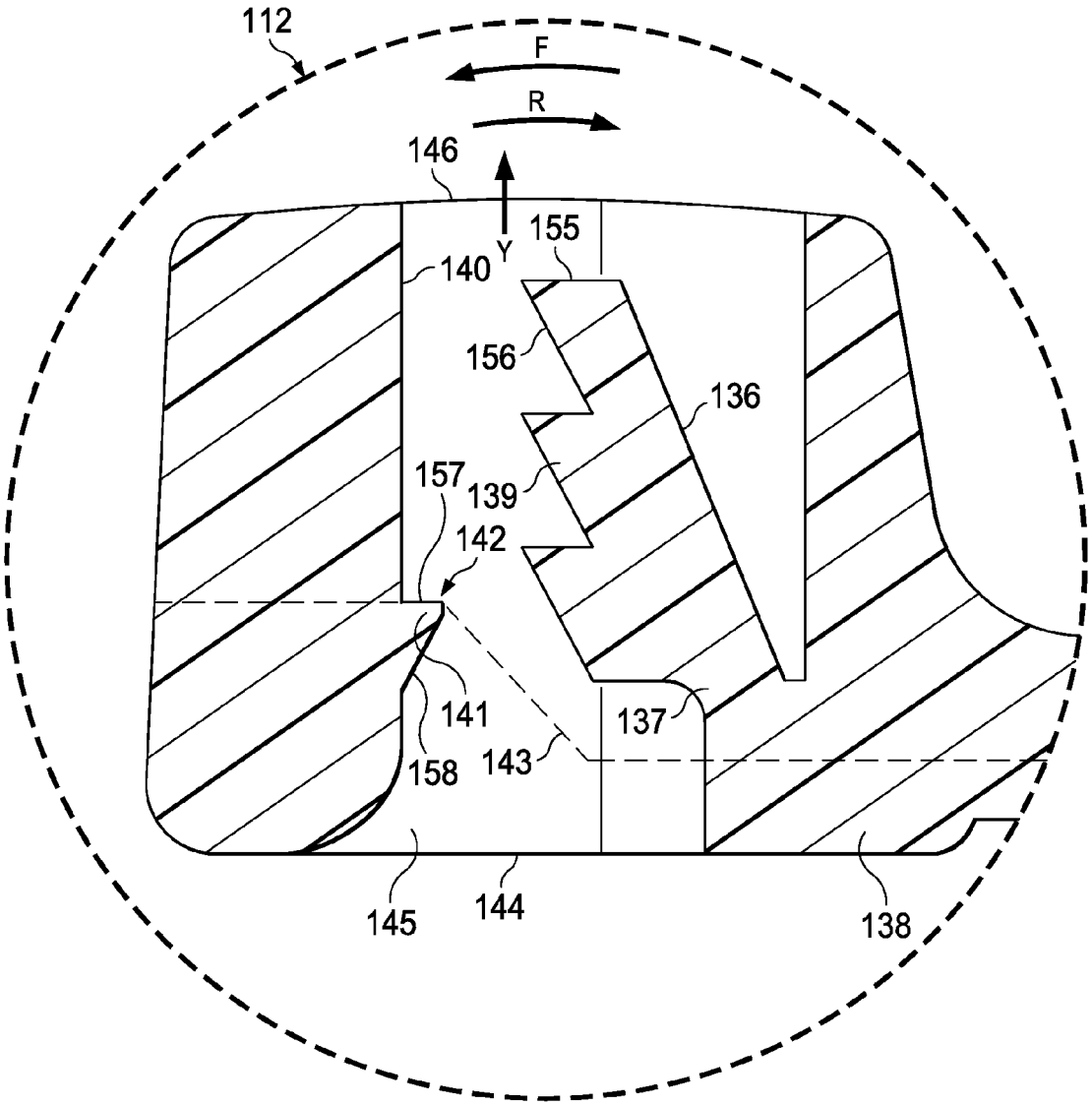
FIG. 5 is a schematic diagram showing a side elevational, or cross-sectional, close-up view, similar to that of FIG. 3, of a head of a cable tie, in accordance with some further alternative embodiments of the present disclosure.
Figure 6:
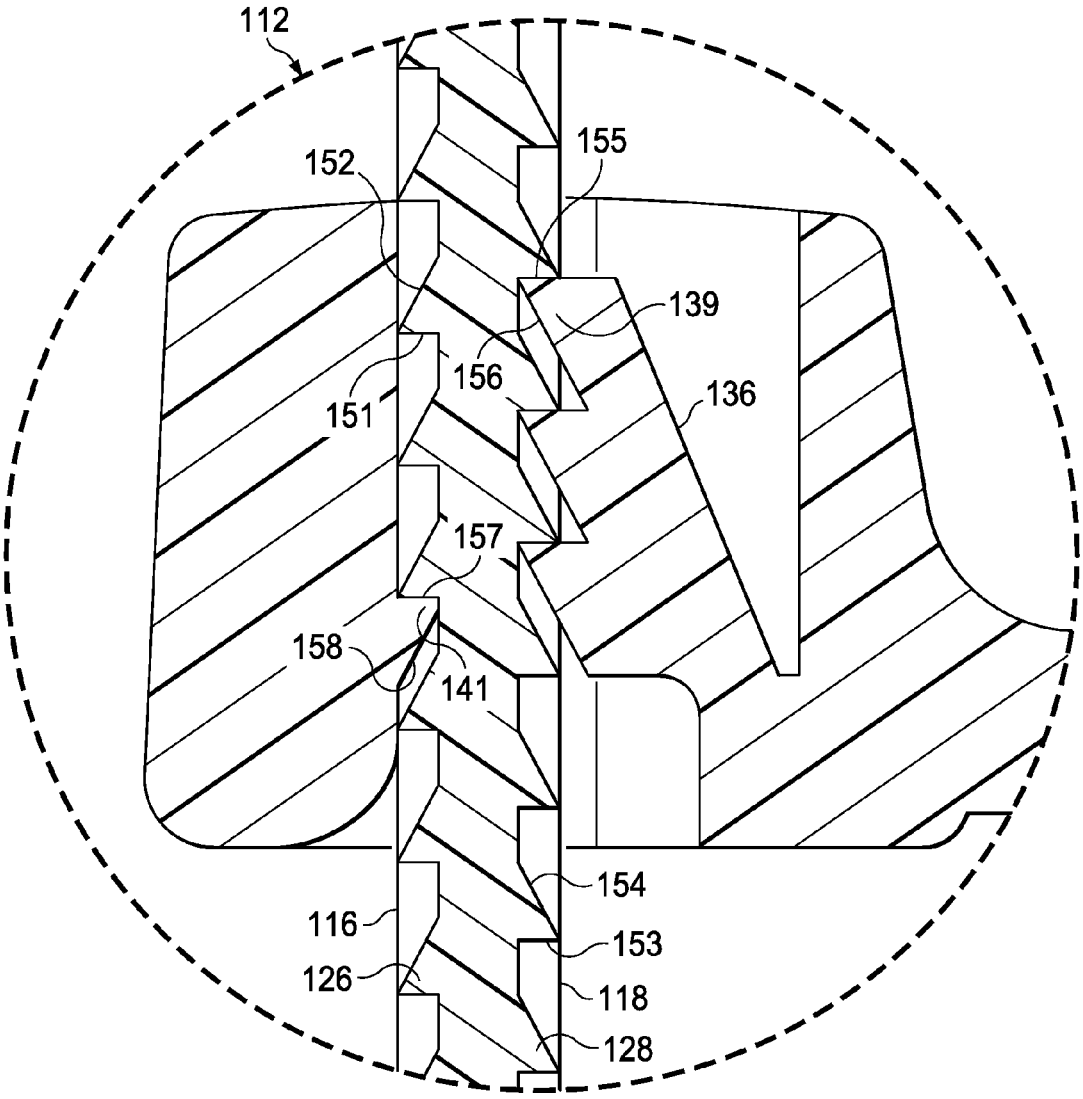
FIG. 6 shows the same view as FIG. 5, but showing also a portion of the strap of the cable tie inserted through the head, with teeth of the strap engaging the tooth of the abutment surface of the head and the teeth of the pawl of the head, in accordance with some further alternative embodiments of the present disclosure.

Head 112 also includes abutment surface 140, which is the interior surface (i.e., the surface facing rear wall 132), or a portion thereof, of front wall 131 (abutment surface 140 may also be referred to as abutment wall 140). Thus, abutment surface 140 may be described as being situated across opening 145 from pawl 136, opposite pawl 136, opposite (interior surface of) rear wall 132, or the like. Disposed on abutment surface 140 is a single abutment tooth 141, in accordance with some embodiments, as illustrated in FIGS. 2-6. Similarly, abutment tooth 141 may be described as being situated across opening 145 from pawl 136, opposite pawl 136, opposite (interior surface of) rear wall 132, or the like. Further, abutment tooth 141 may be described as opposite, or overlapping with, pawl teeth 139, or the like. The term "overlapping" here indicates an overlap between abutment tooth 141 and pawl teeth 139 in the vertical direction of FIGS. 2-6. (In an alternative formulation, this overlap between abutment tooth 141 and pawl teeth 139 in the vertical direction of FIGS. 2-6 may be described thus: abutment tooth 141 is located within an extent of pawl teeth 139.) In alternative embodiments, however, abutment tooth 141 need not overlap pawl teeth 139 in this sense. In accordance with some embodiments, abutment tooth 141 is situated opposite the middle one of the three pawl teeth 139, as shown in FIGS. 2 and 3. In accordance with other embodiments, abutment tooth 141 is situated opposite the top one of the three pawl teeth 139, as shown in FIG. 4. In accordance with still other embodiments, abutment tooth 141 is situated opposite the bottom one of the three pawl teeth 139, as shown in FIGS. 5 and 6. It is to be understood that this location of abutment tooth 141 with respect to pawl teeth 139 is independent of other features illustrated in the figures; that is to say, the location of abutment tooth 141 with respect to pawl teeth 139 may be varied independently of such other features. As discussed below, abutment tooth 141 is configured for engaging top strap teeth 126 when strap 101 has been inserted into opening 145, tail 114 first, with top strap teeth 126 facing abutment surface 140/abutment tooth 141.

In accordance with some other embodiments (not shown), abutment surface 140 may have multiple abutment teeth 141 disposed thereon in a successive manner (i.e., vertically successive in FIGS. 2-6), analogously to the successive manner in which pawl teeth 139 are disposed. The spatial relationship between multiple abutment teeth 141 and pawl teeth 139 may be one of overlap, non-overlap, or partial overlap, in the above-described sense.

In accordance with some embodiments, top strap teeth 126 and bottom strap teeth 128 may be offset laterally (i.e., in the length B direction of strap 101) with respect to one another by one half length of a tooth, as shown in FIGS. 2 and 6. In accordance with other embodiments (not shown), top strap teeth 126 and bottom strap teeth 128 may be offset laterally with respect to one another by a lesser or greater distance, and in accordance with still other embodiments (not shown), top strap teeth 126 and bottom strap teeth 128 are not offset laterally with respect to one.

Similarly, pawl teeth 139 and abutment tooth (or teeth) 141 may be offset with respect to one another in the vertical direction of FIGS. 2-6, by one half length of a tooth, by a greater or lesser distance, or not at all. It is preferable for the amount of offset of pawl teeth 139 with respect to abutment tooth (teeth) 141 to conform to the amount of offset of top strap teeth 126 with respect to bottom strap teeth 128, as shown in FIG. 6. Such conformity may render more effective the engagement between abutment tooth (teeth) 141 and top strap teeth 126 and the engagement between pawl teeth 139 and bottom strap teeth 128, as will be understood from the discussion hereinbelow.

As seen, for example, in FIGS. 4-6, each of top strap teeth 126 has a shorter side 151 and a longer side 152, each of bottom strap teeth 128 has a shorter side 153 and a longer side 154, each of pawl teeth 139 has a shorter side 155 and a longer side 156, and abutment tooth 141 has a shorter side 157 and a longer side 158. In this regard, for all these teeth in general, the angle at which the shorter side intersects the surface from which the respective tooth projects may be closer to 90 degrees than the angle at which the longer side intersects that surface. Specific examples of this are set forth below.

Regarding abutment tooth 141, in accordance with some embodiments shorter side 157 thereof may be disposed at an angle of 90 degrees (i.e., may be disposed perpendicular) with respect to the direction of insertion Y of strap 101, as shown in FIGS. 2, 3, 5 and 6. The direction of insertion Y is shown in FIGS. 3-6. The direction of insertion Y is defined herein as the direction straight upward in FIGS. 3-6, even though strap 101 may be able to be inserted not only in this direction but also at an angle to this direction, as will be understood from the discussion hereinbelow. It will also be understood that the deviation between any such angle and the direction of insertion Y would be limited. As shown in FIGS. 2-6, abutment surface 140 may also extend in the direction straight upward in those figures, although the bottom of front wall 131 may curve away from that direction. Thus, in FIGS. 2, 3, 5 and 6, abutment tooth 141 may also be described as being disposed perpendicular to abutment surface 140.

As an alternative to being disposed perpendicular with respect to abutment surface 140/the direction of insertion Y, in accordance with some embodiments shorter side 157 of abutment tooth 141 may be disposed at an angle that inclines in the direction opposite to the direction of insertion Y (i.e., as the abutment tooth 141 extends away from the abutment surface 140). The direction opposite to the direction of insertion Y is straight downward in FIGS. 3-6. In this case, the inclination in the direction opposite to the direction of insertion Y, that is, the downward inclination, of the angle may (but need not) be quite small. An example is shown in FIG. 4, where shorter side 157 is disposed at an angle of 92 degrees with respect to the direction of insertion Y, amounting to a small inclination (specifically, 2 degrees) in the direction opposite to the direction of insertion Y, that is, in a small downward inclination.

As another alternative to being disposed perpendicular with respect to abutment surface 140/the direction of insertion Y, in accordance with some embodiments shorter side 157 of abutment tooth 141 may be disposed at an angle that inclines in the direction of insertion Y (i.e., as the abutment tooth 141 extends away from the abutment surface 140), or, in other words, shorter side 157 may be disposed at an angle that is inclined in the direction opposite to the direction in which shorter side 157 is inclined in FIG. 4. (The direction of insertion Y is straight upward in FIGS. 3-6.) An example of shorter side 157 disposed at an angle inclined in the direction of insertion Y, that is, in the upward direction (i.e., as the abutment tooth 141 extends away from the abutment surface 140), is not shown but may easily be extrapolated from the explanation herein in view of the figures.

As was the case with abutment tooth 141, so too any of shorter sides 155 of pawl teeth 139, shorter sides 151 of top strap teeth 126, and shorter sides 153 of bottom strap teeth 128 may be disposed perpendicular to the direction of insertion Y, at an angle that is inclined in the direction of insertion Y, or at an angle that is inclined in the direction opposite to the direction of insertion Y. It is understood that this discussion of the dispositions of shorter sides 151 of top strap teeth 126 and shorter sides 153 of bottom strap teeth 128 with respect to the direction of insertion Y assumes that the strap 101 is inserted in head 112 in the direction of insertion Y, as shown in FIG. 6.

As was the case with the offset of top and bottom strap teeth 126, 128, it is preferable that there be a correspondence between the angle of shorter side(s) 157 of abutment tooth (teeth) 141 and the angle of shorter sides 151 of top strap teeth 126, and a correspondence between the angle of shorter sides 155 of pawl teeth 139 and the angle of shorter sides 153 of bottom strap teeth 128. As will be understood from the discussion hereinbelow, such correspondence may render more effective the engagement of abutment tooth (teeth) 141 with top strap teeth 126 and the engagement of pawl teeth 139 with bottom strap teeth 128.

An example of such correspondence is illustrated in FIG. 6, where both the shorter side 157 of abutment tooth 141 and the shorter sides 151 of top strap teeth 126 are perpendicular to (i.e., disposed at an angle of 90 degrees with respect to) the direction of insertion Y, and similarly both the shorter sides 155 of pawl teeth 139 and the shorter sides 153 of bottom strap teeth are disposed at an angle of 90 degrees with respect to (i.e., disposed perpendicular to) the direction of insertion Y. In other words, neither shorter side 157 of abutment tooth 141 nor shorter sides 151 of top strap teeth 126 are inclined in either the direction of insertion Y or the direction opposite the direction of insertion Y, and similarly neither the shorter sides 155 of pawl teeth 139 nor the shorter sides 153 of bottom strap teeth are inclined in either the direction of insertion Y or the direction opposite the direction of insertion Y.

Another example of such correspondence would be where shorter side 157 of abutment tooth 141 is disposed in the direction opposite the direction of insertion Y, or in other words, disposed downward, with respect to the direction of insertion Y (e.g., as shown in FIG. 4, where abutment tooth 141 is disposed at an angle of 92 degrees with respect to direction of insertion Y, hence having a downward inclination of 2 degrees), and shorter sides 151 of top strap teeth 126 are disposed a corresponding amount in the direction of insertion Y, or in other words, disposed upward, with respect to the direction of insertion Y (in this case, shorter sides 151 of top strap teeth 126 would be disposed at an angle of 88 degrees with respect to direction of insertion Y, hence having an upward inclination of 2 degrees) (the case of shorter sides 151 of top strap teeth 126 disposed with an upward inclination of 2 degrees is not shown in the figures). Likewise, shorter sides 155 of pawl teeth 139 could be inclined downward, while shorter sides 153 of bottom strap teeth could be inclined upward, at corresponding amounts.

Another example of such correspondence would be the reverse of that described immediately above: that is, shorter side 157 of abutment tooth 141 would be inclined in the direction of insertion Y, and shorter sides 151 of top strap teeth 126 would be inclined in the direction opposite the direction of insertion Y, in corresponding amounts, and shorter sides 155 of pawl teeth 139 would be inclined in the direction of insertion Y, while shorter sides 153 of bottom strap teeth would be inclined in the direction opposite the direction of insertion Y, in corresponding amounts.

Relatedly to the preferred correspondence between the angle of shorter side 157 of abutment tooth 141 and the angle of shorter sides 151 of top strap teeth 126, and between the angle of shorter sides 155 of pawl teeth 139 and the angle of shorter sides 153 of bottom strap teeth 128, it is preferable that the angle of the shorter sides 157 of all the abutment teeth 141 be the same (that is, in the case in which there are multiple abutment teeth 141), the angle of the shorter sides 155 of all the pawl teeth 139 be the same, the angle of the shorter sides 151 of all the top strap teeth 126 be the same, and the angle of the shorter sides 153 of all the bottom strap teeth 128 be the same.

Head 112 may also have two guide rails 160, as shown in and as will be further described with reference to FIG. 1. Guide rails 160 may be disposed one on either side of pawl 136, with a gap (empty space) between each guide rail 160 and pawl 136, although each guide rail 160 may be connected, at its bottom (defined with respect to the vertical direction in FIGS. 2-6), to a respective side of projection 137 by a structure (not visible in the drawings) between respective guide rail 160 and respective side of projection 137. Guide rails 160 may be formed as projections from the respective inner surfaces (i.e., the surfaces facing opening 145, as against the outer surfaces facing outside of head 112) of side walls 133, 134, respectively. Each guide rail 160 may also project from rear wall 132. While each guide rail 160 may thus be disposed at a corner of rear wall 132 and one of side walls 133, 134, each guide rail 160 may extend to a greater extent along its respective side wall 133 or 134 than along rear wall 132. The direction in which guide rails 160 extend along their respective side walls 133, 134 toward front wall 131/abutment surface 140 may be termed the horizontal direction (consistently with the directions shown in FIGS. 2-6). The extent of each guide rail 160 along its respective side wall 133 or 134, i.e., toward front wall 131/abutment surface 140, may be less than the maximum extent to which pawl 136 in its as-formed position extends in the same direction (it being noted that different portions of pawl 136 in its as-formed position extend toward abutment surface 140/front wall 131 to different extents). In the vertical direction (i.e., the vertical direction of FIGS. 2-6), guide rails 160 may extend from the bottom of perimeter wall 130 (i.e., at entry 144 to opening 145) upward to a height lower than the top of perimeter wall 130 (i.e., lower than exit 146 of opening 145). As will be understood from the discussion hereinbelow, guide rails 160 may serve to guide strap 101 to an appropriate position, e.g., away from pawl 136, as strap 101 is being inserted through opening 145, for ease of insertion, e.g., to avoid having strap 101 prematurely caught (stuck) by pawl 136. The design, e.g., shape, configuration, etc., of guide rails 160 may be varied from that described and illustrated herein, as will be understood by one of ordinary skill in the art.

Turning back to FIGS. 1 and 2, tail 114, which is formed at end portion 104 of strap 101, will now be described. As with body portion 106, so too tail 114 has two opposite wide or broad sides, which may also be referred to as top and bottom, 166 and 168, respectively, and two opposite short sides, 167 and 169, respectively, each extending between top 166 and bottom 168, such as to provide tail 114 with an at least substantially rectangular cross section (not shown), although the length of this cross section (corresponding to the width of top and bottom 166 and 168) varies, as the width G (FIG. 1)

of top 166 and bottom 168 varies (i.e., tapering, as discussed immediately below). (Top 166 and bottom 168 of tail 114 have the same width G.)

As seen in FIG. 1, tail 114 may have a pronounced taper, whereby tail 114 narrows from width A at the juncture with body portion 106 to a much narrower width at the other longitudinal end of tail 114, which may be referred to as tip 115. The width G of tail 114 at tip 115 may approach a point (FIG. 1 is not necessarily drawn to scale), but as shown in FIG. 1 tip 115 may preferably be rounded at its end, e.g., to avoid injury to a user. A relatively pointy tip 115 (even if having a rounded end) may make it easier to insert tail 114 through opening 145 of head 112.

The distance from top 166 to bottom 168 may be termed the height or thickness H of tail 114 (see FIG. 2). The above-mentioned rectangular cross section of tail 114 is defined by the length of the cross section, which is width G of tail 114, and the height of the cross section, which is thickness H of tail 114. In accordance with some embodiments, tail 114 may have a thickness H equal to at least substantially 50% of thickness C of body portion 106. In accordance with other embodiments, tail 114 may have a thickness H substantially equal to thickness C of body portion 106. In accordance with still other embodiments, thickness H of tail 114 may have other values, e.g., less than or greater than 50% of thickness C of body portion 106. A thicker tail 114 provides for increased rigidity, which may make it easier to insert tail 114 through opening 145 of head 112. Thus, tail 114 may (but need not) be substantially as rigid as body portion 106.

As shown in FIG. 2, tail 114 may (but need not) be formed in such a manner as to be deflected downward with respect to body portion 106, that is, tail 114 may incline downward as it extends away (rightward in FIG. 2) from body portion 106.

As seen in FIGS. 1 and 2, top 166 of tail 114 may have ridges 165, which extend transversely with respect to tail 114 (that is, in the direction perpendicular to the longitudinal direction of tail 114) and which are spaced apart from one another in the longitudinal direction of tail 114. This spacing apart may be equidistant between each two adjacent ridges 165. While ten ridges are shown in the figures, in accordance with some other embodiments eight ridges 165 are provided on tail 114. It is noted that tail 114 may have any number of ridges 165, or none at all. As also seen in the figures, though they are not necessarily drawn to scale, the length of tail 114 may be significant in magnitude as compared to that of the length of body portion 106. A large length and abundant ridges 165 of tail 114 may make it easier for a user to get a good grip on tail 114, in particular on a portion of tail 114 that has been inserted through head 112 and exited through exit 146 of opening 145, which would make it easier to pull the rest of tail 114 and then the desired amount of strap 101 through head 112, to fasten cable tie 101 around the desired articles, as will be better understood from the discussion hereinbelow. Nonetheless, as noted, ridges 165 are not required, and it is possible to make tail 114 shorter/short.

In addition, ridges 165 may be spaced apart from one another in the longitudinal direction of tail 114 (i.e., from the juncture of tail 114 with body portion 106 to the tip 115 of tail 114) to a sufficiently greater extent than top strap teeth 126 are spaced apart from one another, and ridges 165 may also have a height sufficiently lesser than the length of shorter side 157 of abutment tooth 141, so that ridges 165 do not, or do not easily, engage with abutment tooth 141 when tail 114 is inserted through opening 145, as discussed hereinbelow.

While FIG. 2 shows ridges 165 only on top 166 of tail 114, it would be possible (in addition or instead) to provide ridges 165 on bottom 168 of tail 114 and to make accommodations with respect to pawl teeth 139 corresponding to those discussed immediately above in respect of ridges 165 on top 166 of tail 114 and abutment tooth 141.

According to some example embodiments, a cable tie 100 may be formed as a one-piece item; that is, cable tie 100 may be formed in such a manner that each of the parts thereof is integral with the parts adjacent thereto.

In accordance with some embodiments, cable tie 100 may be formed by an injection molding process. Such a process may include steps such as the following: providing a mold by combining multiple, e.g., two, mold parts to define a mold cavity for forming cable tie 100; injecting molding material into the mold cavity to form the cable tie 100; solidifying the injected molding material to solidify the cable tie 100; separating the mold parts to open the mold; removing the solidified cable tie 100 from the opened mold, e.g., ejecting the cable tie 100 at a suitable ejection speed. Suitable injection molding processes, and the details thereof, would be understood by one of ordinary sill in the art. In accordance with some embodiments, one mold part may form, among other things, bottom strap teeth 128, while the other mold part may form, among other things, top strap teeth 126. In accordance with other embodiments, the portions of the cable tie 100 may be divided up among (i.e., to be formed by) the two mold parts in a different fashion.

The mold parts, e.g., two mold parts, contact at a contact surface when the mold is closed. When the mold parts are separated and the mold is opened, the finished cable tie may bear a molding line defined by the contact surface. In accordance with some embodiments, cable tie 100 may bear a molding line 143 adjoining the apex 142 of abutment tooth 141, as shown in FIGS. 3 (dotted line 143) and 5 (dashed line 143) and as will be explained further presently. The apex 142 of abutment tooth 141 is the tip where shorter side 157 meets longer side 158. Such molding line 143 may also adjoin shorter side 157, as shown in FIGS. 3 and 5. Shorter side 157 may also be referred to as the working surface, working face, occluding surface or occluding face of abutment tooth 141.

In accordance with some embodiments, as shown in FIG. 5, after adjoining apex 142 molding line 143 (shown as a dashed line) may, e.g., slope downward to the right below pawl 136 and then continue straight (rightward) in such a manner as to avoid going through pawl 136. In accordance with other embodiments, after adjoining apex 142 molding line 143 may follow a different path, as will be understood by one of ordinary skill in the art. This is intended to be illustrated by FIG. 3, where molding line 143 (shown as a dotted line) begins at the left side of head 112 and is drawn only to apex 142 of abutment tooth 141: the remaining portion of molding line 143 (i.e., the path molding line 143 would continue to follow after apex 142) is omitted to indicate that molding line 143 may follow any of a wide if not infinite range of different paths, as will be understood by one of ordinary skill in the art. To cite merely one example of such a path, after adjoining apex 142 molding line 143 may continue straight in the horizontal direction, i.e., rightward in FIG. 3, through middle pawl tooth 139, through the gap (open space) to the right thereof, and through rear wall 132.

It should be noted that, while different molding lines are shown on different structures, it is not required that particular molding lines be formed for particular structures, or that particular structures have particular molding lines. By "different structures" it is meant, for example, that FIG. 3 shows a structure with, inter alia, abutment tooth 141 opposite middle pawl tooth 139, while FIG. 5 shows a structure with, inter alia, abutment tooth 141 opposite bottom pawl tooth 139. However, it would be possible for the structure of FIG. 3 to have the molding line shown in FIG. 5 (e.g., still adjoining the apex 142 of abutment tooth 141 shown in FIG. 3), and for the structure of FIG. 5 to have the molding line shown in FIG. 3 (e.g., still adjoining the apex 142 of abutment tooth 141 shown in FIG. 5 and either continuing straight in the horizontal direction, i.e., rightward in FIG. 5, through bottom pawl tooth 139, through the gap (open space) to the right thereof, and through rear wall 132, analogously to the last example given in the previous paragraph, or along a different path). Either of the molding lines of FIG. 3 (continuing straight as in the last example given in the previous paragraph) or FIG. 5, or another molding line as described herein (e.g., as in FIG. 3 but following a different path), could be employed with any structure (design, configuration, etc.) described and/or illustrated herein. With regard to the embodiments set forth immediately below, which are described in terms of molding lines (and in some cases abutment teeth), it is not to be taken that these embodiments require any particular aspects of the structure of FIG. 3 or FIG. 5 or of any other particular structure, except as specified below (an example of such exception being that a certain embodiment may be described as having only a single abutment tooth or as having multiple abutment teeth).

In accordance with some embodiments, cable tie 100 is formed with no molding line other than the one shown in FIG. 3. In accordance with other embodiments, cable tie 100 is formed with no molding line other than the one shown in FIG. 5.

In accordance with some embodiments, cable tie 100 is formed with no molding line other than the one shown in FIG. 3, and is formed with only a single abutment tooth 141. In accordance with other embodiments, cable tie 100 is formed with no molding line other than the one shown in FIG. 5, and is formed with only a single abutment tooth 141.

In accordance with some embodiments, cable tie 100 is formed with no molding line other than the one shown in FIG. 3, and is formed with multiple abutment teeth 141. In accordance with other embodiments, cable tie 100 is formed with no molding line other than the one shown in FIG. 5, and is formed with multiple abutment teeth 141.

In accordance with some embodiments, cable tie 100 is formed with multiple abutment teeth 141 and with molding line 143 as shown in FIG. 3, and with no other molding line that adjoins an apex of an abutment tooth 141. In accordance with other embodiments, cable tie 100 is formed with multiple abutment teeth 141 and with molding line 143 as shown in FIG. 5, and with no other molding line that adjoins an apex of an abutment tooth 141.

In accordance with some alternative embodiments, cable tie 100 is formed with a single abutment tooth 141 and a molding line that does not adjoin the apex 142 of abutment tooth 141.

In accordance with some other alternative embodiments, cable tie 100 is formed with multiple abutment teeth 141 and a molding line that does not adjoin the apex 142 of at least one of the multiple abutment teeth 141.

In accordance with some other alternative embodiments, cable tie 100 is formed with multiple abutment teeth 141 and a molding line that does not adjoin the apex 142 of any of the multiple abutment teeth 141.

In accordance with still other alternative embodiments, cable tie 100 may be formed with one or more molding lines in any location. According to some such alternative embodiments, cable tie 100 may be formed without a molding line adjoining an apex of an abutment tooth. As merely a few examples, cable tie 100 may be formed with one or more molding lines, none of which adjoins an apex of any abutment tooth (whether there be one or more abutment teeth), or none of which adjoins an apex of at least one abutment tooth among multiple abutment teeth.

Cable tie 100 may be formed of a suitable, e.g., plastic, material, e.g., nylon. The material of formation is preferably sufficiently flexible to accommodate the deformation to which the parts of cable tie 100 are subject during use of cable tie 100, as described herein. In accordance with some embodiments, cable tie 100 is made of PA66 (Nylon 6.6). In accordance with various embodiments, the material of formation of cable tie 100 may be any of various colors, may be heat resistant, and/or may be UV resistant, e.g., for outdoor use.

Methods of using cable tie 100 will now be described with reference to the figures, in particular FIGS. 1, 2, 5 and 6. As a preliminary, it will be noted that head 112 is dimensioned to accommodate insertion of strap 101 through opening 145 in head 112. For example, while perimeter wall 130, or equivalently walls 131-135 thereof, may be formed relatively thick, in order to provide increased strength and resistance to retraction of strap 101 from head 112, still walls 131-135 are appropriately sized and spaced apart so as to accommodate strap 101. Thus, the width of opening 145 (i.e., the distance between the opposing interior surfaces of side walls 133, 134) may be made larger, at least slightly, than the width A (FIG. 1) of broad sides 116, 118 of body portion 106, for ease of insertion of body portion 106 through opening 145. Also, pawl 136 may be appropriately positioned, as to the extent to which it extends outward in opening 145 toward abutment surface 140/front wall 131, and with respect to guide rails 160, as to permit passage of strap 101 through opening 145 without getting caught (stuck) by pawl teeth 139 prematurely. Similarly, abutment tooth (or teeth) 141 may be appropriately positioned as to the extent to which it (they) extend(s) outward in opening 145 toward rear wall 132/pawl 136, as to permit passage of strap 101 through opening 145 without getting caught (stuck) by abutment tooth (or teeth) 141 prematurely.

Cable tie 100 may be used to tie together and retain a group or bundle of cables (wires), or other articles. To achieve this, cable tie 100 is formed into a loop around the articles and strap 101 is inserted (in direction of insertion Y), tail 114 first, into head 112, that is, into entry 144 of opening 145 and through opening 145, such that tail 114 and a portion of body portion 106 exit through exit 146 of opening 145. Arrow L in FIG. 2 indicates the direction in which strap 101 is formed into a loop around the articles, to be inserted into head 112.

As mentioned, the rigidity and tapering of tail 114 and the ridges 165 disposed thereon facilitate gripping tail 114 and guiding tail 114 into entry 144 of opening 145 in head 112. Again, as mentioned, strap 101 may be inserted into head 112 at a direction offset from direction Y, but as strap 101 is further inserted through opening 145 it will generally be straightened to direction Y by virtue of the structure of head 112, e.g., pawl 136 and walls 131-135.

As strap 101 is inserted through entry 144 into opening 145 of head 112, tail 114 may be guided toward front wall 131 (i.e., leftward in FIGS. 2-6) by guide rails 160 so that strap 101 enters opening 145 in appropriate position with respect to movable pawl 136. Movable pawl 136 may be pushed rearward (i.e., rightward in FIGS. 2-6), i.e., pivoted in the direction indicated by arrow R in FIGS. 3-5, by tail 114 and/or body portion 106 of strap 101 as strap 101 is inserted through opening 145.

As mentioned, cable tie 100 is configured so that the teeth in head 112 (i.e., pawl teeth 139 and abutment tooth 141) will engage the teeth on strap 101 (i.e., bottom strap teeth 128 and top strap teeth 126, respectively). For example, the teeth to be engaged with each other may be configured in a complementary or mating fashion, as shown, e.g., in FIG. 6. Such engaging teeth may be referred to as occlusive teeth. Again, as mentioned, ridges 165 are spaced apart sufficiently so that the teeth in head 112 will not, or not unduly, engage ridges 165, so that tail 114 can be easily slid through opening 145. After strap 101 has been inserted into head 112 sufficiently such that top and bottom strap teeth 126, 128 reach pawl teeth 139 and abutment tooth 141, abutment tooth 141 may engage top strap teeth 126 and pawl teeth 139 may engage bottom strap teeth 128. This engagement is characterized in that, by virtue of the configuration (mating shapes) of the teeth, a user may continue to pull (e.g., in a ratchet-like fashion) strap 101 through opening 145 and out through exit 146, in the direction of insertion Y, but may not be able to retract strap 101 backward through opening 145, out through entry 144, in the direction opposite the direction of insertion Y, except in the limited sense discussed immediately below.

Hinge 137 of pawl 136 is configured so that, when one or more of pawl teeth 139 are engaged with one or more of bottom strap teeth 128, pawl 136 tends to move toward abutment surface 140 (i.e., in the direction of arrow F, shown in FIGS. 3-5) in response to pressure applied to strap 101 in a direction opposite to the direction of insertion Y (i.e., in response to retraction pressure). Thus, retraction pressure forces top 116 of strap 101 including top strap teeth 126 against abutment surface 140 and/or abutment tooth 141. Thus, in the state immediately after insertion of strap 101 into opening 145, during initial engagement of the teeth, pawl 136 may be positioned in position that is slightly shifted rearward (i.e., in the direction of arrow R, shown in FIGS. 3-5), as compared to the position shown in FIG. 6. Subsequently, when a retraction force is applied to strap 101, e.g., a user, or the mere weight of the articles enclosed by cable tie 100, attempts to pull strap 101 downward back out through entry 144, the applied force is transmitted to pawl 136, causing pawl 136 to move slightly forward (i.e. in the direction of arrow F, shown in FIGS. 3-5) via hinge 137, such that strap 101 is slightly refracted, with the appropriately positioned one of top strap teeth 126 being brought into closer engagement with abutment tooth 141 and the appropriately positioned ones of bottom strap teeth 128 being brought into closer engagement with pawl teeth 139, as shown in FIG. 6. With this closer engagement of the teeth, cable tie 100 provides maximum resistance to refraction of strap 101 from head 112. At this stage, further retraction force on strap 101 tends to move the teeth in the direction of closer engagement with one another (i.e., tends to move strap 101 toward a position in which strap 101 is more tightly locked in head 112).

In the engaged state, thus, strap 101 is effectively locked in place in head 112, such that strap 101 is not retractable from head 112, i.e., cannot be pulled back out through entry 144. In this state, strap 101 may still be able to be pulled further through exit 146. With this state of cable tie 100 achieved, assuming strap 101 has been tightly tensioned around the articles, the articles are securely retained in cable tie 100. Release of the articles would require cutting or breaking of the cable tie 100 (e.g., strap 101), or the like.

Cable tie 100 may also be designed (e.g., with greater spacing between pawl teeth 139 and inserted strap 101) such that, upon initial insertion of strap 101 into opening 145 of head 112, pawl teeth 139 engage bottom strap teeth 128 only to a limited extent, and it is only after a refraction force is applied to strap 101, causing pawl 136 and strap 101 to be consequently pulled downward and toward abutment surface 140, that pawl teeth 139 and abutment tooth 141 more fully engage appropriate ones of bottom strap teeth 128 and top strap teeth 126, respectively.

Given the configuration of the teeth, e.g., the dimensions and angles of the shorter and longer sides thereof, cable tie 100 is designed for insertion of strap 101 into entry 144, through opening 145, and out through exit 146, and is not designed for insertion of strap 101 into exit 146, through opening 145, and out through entry 144. The embodiments set forth herein are not designed to provide non-retractable engagement of strap 101 in head 112 when strap 101 is inserted through opening 145 in such reverse direction (assuming, for the sake of argument, that such insertion is possible.)

With regard to terminology, it is noted that the short sides 151, 153, 155 and 157 of the teeth may be referred to as the working surfaces, working faces, occluding surfaces or occluding faces of the teeth. A cable tie with teeth on both broad sides (top and bottom) of the strap (and with teeth on two opposite sides of the opening in the head) may be referred to as a double-faced or double-sided cable tie.

In light of the principles and example embodiments described and illustrated herein, it will be recognized that the example embodiments can be modified in arrangement and detail without departing from such principles. Also, the foregoing discussion has focused on particular embodiments, but other configurations are contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments. As a rule, any embodiment referenced herein is freely combinable with any one or more of the other embodiments referenced herein, unless indicated otherwise.

This disclosure may include descriptions of various benefits and advantages that may be provided by various embodiments. One, some, all, or different benefits or advantages may be provided by different embodiments.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A fastening device, comprising:

a flexible, elongated strap having longitudinally opposed first and second end portions and a body portion therebetween, the body portion having opposed first and second broad sides and strap teeth on each of the first and second broad sides;

a head disposed at the first end portion, the head having (a) a perimeter wall surrounding an opening, the opening having only a single entry and only a single exit, and (b) a movable pawl extending from the perimeter wall into the opening, the movable pawl having at least one pawl tooth, the perimeter wall including an abutment portion opposite the movable pawl, the abutment portion including an abutment tooth opposite the movable pawl; and a tail disposed at the second end portion, wherein the opening is dimensioned to accommodate insertion, tail first, of the strap through the single entry of the opening, wherein the strap teeth on the first broad side and the at least one pawl tooth are respectively configured for engagement therebetween, upon the tail-first insertion of the strap through the single entry of the opening, wherein the strap teeth on the second broad side and the abutment tooth are respectively configured for engagement therebetween, upon the tail-first insertion of the strap through the single entry of the opening, and wherein the abutment tooth has a working surface inclined in a direction opposite a direction of insertion;

wherein the strap teeth on the first broad side are offset from the strap teeth on the second broad side by one half of a tooth length of a strap tooth of the strap teeth on the first or second broad side.

2. A fastening device as claimed in claim 1, wherein at least one of the strap teeth on the second broad side has a working surface that, upon the tail-first insertion of the strap through the opening, is inclined in the direction of insertion.

3. A fastening device as claimed in claim 1, wherein the abutment tooth is located within an extent of the at least one pawl tooth.

4. A fastening device, comprising:

a flexible, elongated strap having longitudinally opposed first and second end portions and a body portion therebetween, the body portion having opposed first and second broad sides and strap teeth on each of the first and second broad sides;

a head disposed at the first end portion, the head having (a) a perimeter wall surrounding an opening, and (b) a movable pawl extending from the perimeter wall into the opening, the movable pawl having at least one pawl tooth, the perimeter wall including an abutment portion opposite the movable pawl, the abutment portion including an abutment tooth opposite the movable pawl; and a tail disposed at the second end portion, wherein the opening is dimensioned to accommodate insertion, tail first, of the strap through the opening, wherein the strap teeth on the first broad side and the at least one pawl tooth are respectively configured for engagement therebetween, upon the tail-first insertion of the strap through the opening, wherein the strap teeth on the second broad side and the abutment tooth are respectively configured for engagement therebetween, upon the tail-first insertion of the strap through the opening, and wherein at least one of the strap teeth on the second broad side has a working surface that, upon the tail-first insertion of the strap through the opening, inclines in a direction of insertion as the working surface of the at least one of the strap teeth on the second broad side extends away from the second broad side, for mating engagement with the abutment tooth;

wherein the abutment tooth is located within an extent of the at least one pawl tooth.

5. A fastening device as claimed in claim 4, wherein the abutment tooth has a working surface inclined in a direction opposite the direction of insertion.

6. A fastening device as claimed in claim 4, wherein the strap teeth on the first broad side are offset from the strap teeth on the second broad side by one half of a tooth length of a strap tooth of the strap teeth on the first or second broad side.

7. A fastening device as claimed in claim 4, wherein the opening has only a single entry and only a single exit.

8. A fastening device as claimed in claim 1, wherein the movable pawl has a plurality of pawl teeth.

9. A fastening device as claimed in claim 1, wherein the abutment tooth has only a single working surface.

10. A fastening device as claimed in claim 4, wherein the movable pawl has a plurality of pawl teeth.

11. A fastening device, comprising:

a flexible, elongated strap having longitudinally opposed first and second end portions and a body portion therebetween, the body portion having opposed first and second broad sides and strap teeth on each of the first and second broad sides;

a head disposed at the first end portion, the head having (a) a perimeter wall surrounding an opening, the opening having only a single entry and only a single exit, and (b) a movable pawl extending from the perimeter wall into the opening, the movable pawl having at least one pawl tooth, the perimeter wall including an abutment portion opposite the movable pawl, the abutment portion including an abutment tooth opposite the movable pawl; and a tail disposed at the second end portion, wherein the opening is dimensioned to accommodate insertion, tail first, of the strap through the single entry of the opening, wherein the strap teeth on the first broad side and the at least one pawl tooth are respectively configured for engagement therebetween, upon the tail-first insertion of the strap through the single entry of the opening, wherein the strap teeth on the second broad side and the abutment tooth are respectively configured for engagement therebetween, upon the tail-first insertion of the strap through the single entry of the opening, and wherein the abutment tooth has a working surface inclined in a direction opposite a direction of insertion as the working surface of the abutment tooth extends away from the abutment portion, wherein the abutment tooth is located within an extent of the at least one pawl tooth.

12. The fastening device of claim 11, wherein at least one of the strap teeth on the second broad side has a working surface that, upon the tail-first insertion of the strap through the opening, is inclined in a direction of insertion for mating engagement with the abutment tooth.

13. The fastening device of claim 11, wherein the abutment tooth has an apex, and the head has a molding line adjoining the apex of the abutment tooth.

14. The fastening device of claim 11, wherein no other molding line is formed on the fastening device.

15. The fastening device of claim 11, wherein the abutment portion includes no additional abutment teeth opposite the pawl.

16. A fastening device, comprising:

a flexible, elongated strap having longitudinally opposed first and second end portions and a body portion therebetween, the body portion having opposed first and second broad sides and strap teeth on each of the first and second broad sides;

a head disposed at the first end portion, the head having (a) a perimeter wall surrounding an opening, and (b) a movable pawl extending from the perimeter wall into the opening, the movable pawl having at least one pawl tooth, the perimeter wall including an abutment portion opposite the movable pawl, the abutment portion including an abutment tooth opposite the movable pawl; and a tail disposed at the second end portion, wherein the opening is dimensioned to accommodate insertion, tail first, of the strap through the opening, wherein the strap teeth on the first broad side and the at least one pawl tooth are respectively configured for engagement therebetween, upon the tail-first insertion of the strap through the opening, wherein the strap teeth on the second broad side and the abutment tooth are respectively configured for engagement therebetween, upon the tail-first insertion of the strap through the opening, and wherein at least one of the strap teeth on the second broad side has a working surface that, upon the tail-first insertion of the strap through the opening, inclines in a direction of insertion as the working surface of the at least one of the strap teeth on the second broad side extends away from the second broad side, for mating engagement with the abutment tooth;

wherein the strap teeth on the first broad side are offset from the strap teeth on the second broad side by one half of a tooth length of a strap tooth of the strap teeth on the first or second broad side.

17. The fastening device of claim 16, wherein the abutment tooth is located within an extent of the at least one pawl tooth.

18. The fastening device of claim 16, wherein the abutment tooth has a working surface inclined in a direction opposite the direction of insertion.

19. The fastening device of claim 16, wherein the opening has only a single entry and only a single exit.

* * * * *